US010415582B2

(12) United States Patent
Niu et al.

(10) Patent No.: US 10,415,582 B2
(45) Date of Patent: Sep. 17, 2019

(54) ELECTRICALLY DRIVEN PUMP

(71) Applicant: ZHEJIANG SANHUA AUTOMOTIVE COMPONENTS CO., LTD., Hangzhou, Zhejiang (CN)

(72) Inventors: Lianjing Niu, Zhejiang (CN); Junchao Zhang, Zhejiang (CN); Rongrong Zhang, Zhejiang (CN); Junfeng Bao, Zhejiang (CN); Chen Fang, Zhejiang (CN)

(73) Assignee: HANGZHOU SANHUA RESEARCH INSTITUTE CO., LTD., Hangzhou, Zhejiang (CN)

( * ) Notice: Subject to any disclaimer, the term of this patent is extended or adjusted under 35 U.S.C. 154(b) by 503 days.

(21) Appl. No.: 15/196,004

(22) Filed: Jun. 28, 2016

(65) Prior Publication Data

US 2017/0009779 A1 Jan. 12, 2017

(30) Foreign Application Priority Data

Jul. 6, 2015 (CN) ..... 2015 1 0393337

(51) Int. Cl.
*F04D 29/18* (2006.01)
*F04D 29/24* (2006.01)
(Continued)

(52) U.S. Cl.
CPC ..... *F04D 29/242* (2013.01); *F04D 1/00* (2013.01); *F04D 13/06* (2013.01);
(Continued)

(58) Field of Classification Search
CPC ..... F04D 29/242; F04D 1/00; F04D 13/06; F04D 13/0606; F04D 17/08;
(Continued)

(56) References Cited

U.S. PATENT DOCUMENTS 4,093,401 A * 6/1978 Gravelle ..... F04D 29/284 415/143
5,002,461 A * 3/1991 Young ..... F04D 29/284 416/183
(Continued)

FOREIGN PATENT DOCUMENTS

JP H0431695 A 2/1992
JP 2961686 B2 * 5/1996
(Continued)

OTHER PUBLICATIONS

Machine Translation—JP-2961686-B2 (Year: 1996).*
(Continued)

*Primary Examiner* — Justin D Seabe
*Assistant Examiner* — Brian Christopher Delrue
(74) *Attorney, Agent, or Firm* — Yue (Robert) Xu; Apex Attorneys at Law, LLP

(57) ABSTRACT

An electrically driven pump is provided, which includes an impeller. The impeller includes an upper plate, blades and a lower plate. The blades are formed on a lower surface of the upper plate, the blades include first blades and second blades, and a length of each of the first blades is greater than a length of each of the second blades. The first blades are uniformly distributed along a circumference of the upper plate. The first blades and the second blades are distributed alternately in the circumferential direction. The first blades each include a first head portion and a first tail portion, the second blade includes a second head portion and a second tail portion, and the first tail portion and the second tail portion are aligned with outer edge of the upper plate. The impeller arranged in such manner facilitates the improvement of hydraulic efficiency and lift.

9 Claims, 4 Drawing Sheets

(51) Int. Cl.

| | |
|---|---|
| ***F04D 13/06*** | (2006.01) |
| ***F04D 29/22*** | (2006.01) |
| ***F04D 1/00*** | (2006.01) |
| ***F04D 17/08*** | (2006.01) |
| ***F04D 25/06*** | (2006.01) |
| ***F04D 29/02*** | (2006.01) |
| ***F04D 29/30*** | (2006.01) |
| ***F04D 29/58*** | (2006.01) |
| ***F28F 99/00*** | (2006.01) |

(52) U.S. Cl.
CPC ..... *F04D 13/0606* (2013.01); *F04D 17/08* (2013.01); *F04D 25/0606* (2013.01); *F04D 29/02* (2013.01); *F04D 29/2222* (2013.01); *F04D 29/30* (2013.01); *F04D 29/5813* (2013.01); *F28F 99/00* (2013.01); *F05B 2230/20* (2013.01); *F05B 2230/22* (2013.01); *F05B 2240/30* (2013.01); *F05B 2280/6003* (2013.01); *F28F 2250/08* (2013.01)

(58) Field of Classification Search
CPC .. F04D 25/0606; F04D 29/02; F04D 29/2222; F04D 29/30; F04D 29/5813; F28F 99/00; F28F 2250/08; F05B 2230/20; F05B 2230/22; F05B 2240/30; F05B 2280/6003
See application file for complete search history.

(56) References Cited

U.S. PATENT DOCUMENTS 5,639,217 A * 6/1997 Ohtsuki ..... F04D 29/284 416/183
5,749,707 A * 5/1998 Nomoto ..... F04D 29/242 416/185
7,179,050 B2 * 2/2007 Hopfensperger ..... F04D 29/281 415/204
7,618,239 B2 * 11/2009 Hatsugai ..... F04D 29/666 416/185
8,109,731 B2 * 2/2012 Keber ..... F04D 29/023 416/186 R
8,834,121 B2 * 9/2014 Ikeda ..... F04D 25/088 416/186 R
9,719,523 B2 * 8/2017 Jayaram ..... F04D 1/00
2006/0280609 A1 * 12/2006 Ranz ..... B23P 15/006 416/182
2008/0304986 A1 * 12/2008 Kenyon ..... A61M 16/0066 417/423.12
2011/0173975 A1 * 7/2011 Sun ..... F02B 47/08 60/605.2
2016/0319822 A1 * 11/2016 Niu ..... F04D 17/10

FOREIGN PATENT DOCUMENTS

JP 2961686 B2 10/1999
JP 2010065528 * 3/2010
JP 2010065528 A 3/2010

OTHER PUBLICATIONS

Machine Translation—JP-2010065528 (Year: 2010).*
Second Office Action dated Feb. 20, 2018 for Japanese application No. 2016-128423. English translation provided by https://globaldossier.uspto.gov/#/.
European Search Report for 16176902.1-1607, dated Dec. 6, 2016.

* cited by examiner

ELECTRICALLY DRIVEN PUMP

CROSS REFERENCE OF RELAYED APPLICATION

The present application claims the priority to Chinese Patent Application No. 201510393337.8, titled "IMPELLER, CENTRIFUGAL PUMP, ELECTRICALLY DRIVEN PUMP", filed on Jul. 6, 2015, with the State Intellectual Property Office of the People's Republic of China, the content of which is incorporated herein by reference in its entirety.

FIELD

This application relates to a component in a heat circulating system.

BACKGROUND

In recent decades, electrically driven pumps have been widely used in heat circulating systems. Currently, the heat circulating systems are developed in a trend of high performance, and compactification, accordingly, the electrically driven pump has a limited mounting space, and has requirements for high performance. Since the electrically driven pump has a small overall dimension and a small volume, the electrically driven pump includes an impeller, a diameter of the impeller is required to be small, in this case, a conventional impeller can hardly meet the requirements for high lift and high efficiency at low specific speed and low flow rate.

Therefore, it is necessary to improve the conventional technology, to address the above technical issues.

SUMMARY

An object of the present application is to provide an electrically driven pump, which may achieve the required flow rate and lift at a low speed, and may achieve a high hydraulic efficiency.

To achieve the above objects, the following technical solutions are adopted in the present application. An electrically driven pump includes a rotor assembly, a stator assembly, and a partition. The rotor assembly and the stator assembly are partitioned by the partition. The rotor assembly includes an impeller, the impeller includes an upper plate, blades, and a lower plate, and the blades are provided between the upper plate and the lower plate. The upper plate includes an upper surface and a lower surface, the blades and the upper plate are integrally formed by injection molding, and the blades are located on the lower surface of the upper plate. The blades include first blades and second blades, and each of the first blades and the second blades includes a camber, or a combination of two or more than two cambers, or a combination of a camber and a plane. A length of each of the first blades is greater than a length of each of the second blades, the first blades are uniformly distributed along a circumference of the upper plate, and the second blades are uniformly distributed along the circumference of the upper plate. A number of the first blades is the same as a number of the second blades, and the first blades and the second blades are distributed alternately along the circumferential direction of the upper plate. Each of the first blades includes a first head portion and a first tail portion, and each of the second blades includes a second head portion and a second tail portion. An outer edge of the upper plate defines a first circumference with a diameter of Φ1, the second head portions of the second blades are located on a second circumference with a diameter of Φ2, and the diameter Φ2 of the second circumference ranges 0.6 times to 0.75 times of the diameter Φ1 of the first circumference.

Compared with the conventional technology, the electrically driven pump according to the present application includes the impeller, the impeller includes the upper plate, the blades and the lower plate, and the blades are arranged between the upper plate and the lower plate. The blades include the first blades and the second blades, the outer edge of the upper plate defines the first circumference with a diameter of Φ1, the head portions of the second blades are located on the second circumference with a diameter of Φ2, and the diameter of the second circumference ranges from 0.6 times to 0.7 times of the diameter of the first circumference. The impeller arranged in such manner facilitates achieving a required flow rate and lift by the electrically driven pump, and facilitates the improvement of a hydraulic efficiency of the electrically driven pump.

DETAILED DESCRIPTION

The present application is further described in conjunction with drawings and embodiments hereinafter.

Figure 1:
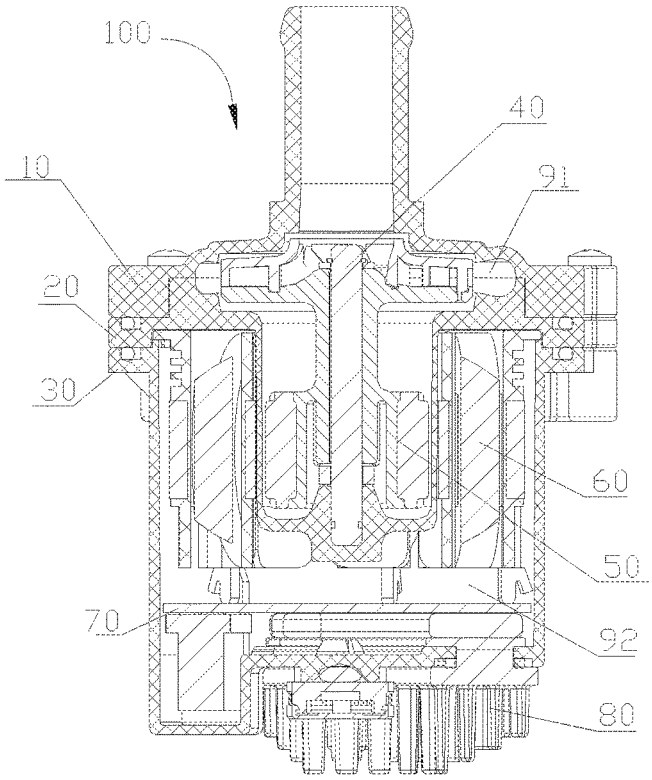
FIG. 1 is a schematic sectional view showing the structure of an electrically driven pump according to an embodiment of the present application.

FIG. 1 is a schematic view showing the structure of an electrically driven pump 100. The electrically driven pump 100 includes a first housing 10, a partition 20, a second housing 30, a shaft 40, a rotor assembly 50, a stator assembly 60, a circuit board 70 and a heat dissipating assembly 80. An inner chamber of the electrically driven pump includes a space defined by the first housing 10 and the second housing 30, and the partition 20 divides the inner chamber of the electrically driven pump into a first chamber 91 and a second chamber 92. The first chamber 91 allows working medium to flow through, and the rotor assembly 50 is arranged in the first chamber 91. No working medium flows through the second chamber 92, and the stator assembly 60 and the circuit board 70 are arranged in the second chamber 92. The shaft 40 is fixed to the partition 20 by injection molding. The rotor assembly 50 is rotatable about the shaft 40. The rotor assembly 50 is separated from the stator assembly 60 by the partition 20. The stator assembly 60 is electrically connected to the circuit board 70. The circuit board 70 is connected to an external circuit by a socket-connector. The heat dissipating assembly 80 is configured to transfer and dissipate heat generated by the circuit board 70, and the heat dissipating assembly 80 is fixedly mounted to the second housing 30. In this embodiment, the electrically driven pump 100 is an inner rotor type electrically driven pump, and the inner rotor type electrically driven pump is referred to as a pump in which the rotor assembly 50 is arranged to be closer to the shaft 16 than the stator assembly 60 if the shaft 40 is taken as a central axis. In this embodiment, the shaft 40 is arranged to be fixed with respect to the partition 20, and the rotor assembly 50 is rotatable with respect to the shaft 40. Of course, the shaft 40 may also rotate with respect to the partition 20 by means of the shaft sleeve, and the rotor assembly 50 may be fixed to the shaft 40 and rotate along with the shaft 40.

Figure 2:
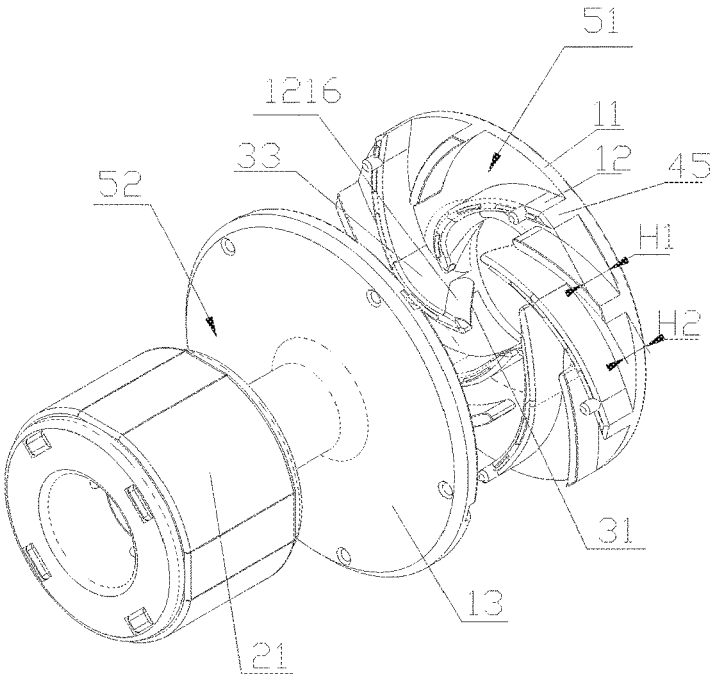
FIG. 2 is a schematic exploded view showing the structure of a rotor assembly in FIG. 1.
Figure 3:
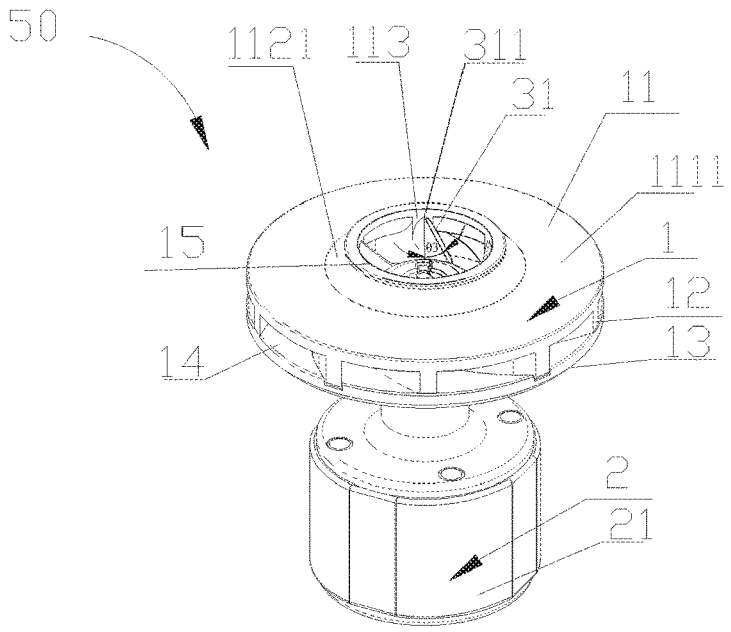
FIG. 3 is a schematic perspective view showing the structure of the rotor assembly in FIG. 1.
Figure 4:
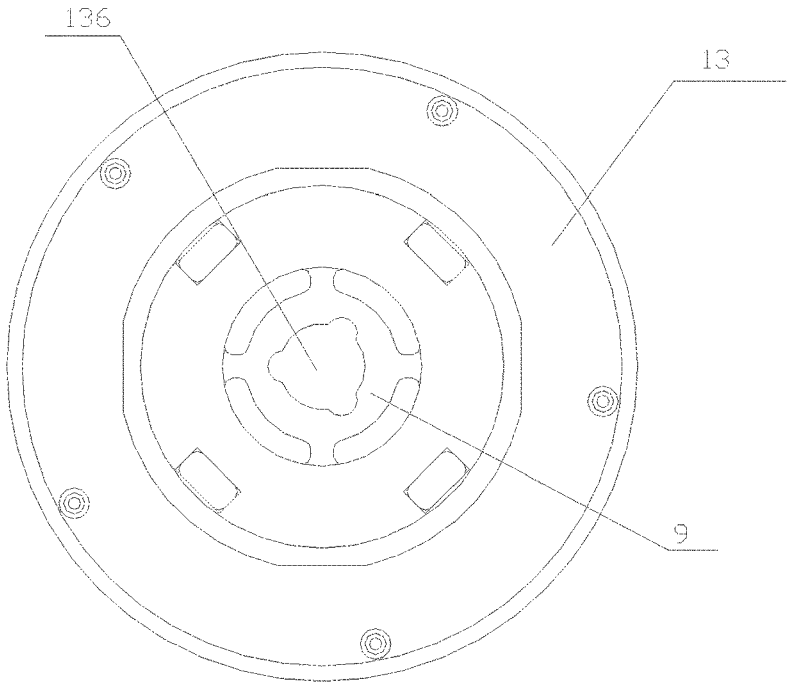
FIG. 4 is a schematic orthographic view showing the structure of the rotor assembly in FIG. 2 viewed from a top.

FIGS. 2 to 9 are schematic views showing the structure of the rotor assembly 50. Referring to FIG. 2, the rotor assembly 50 includes two parts of injection molded members, respectively a first part 51 and a second part 52 which are fixed to each other by welding. The first part 51 includes an upper plate 11 and blades 12, and the first part 51 is integrally formed by injection molding. In an embodiment, the material for the injection molding is a mixture including polyphenylene sulfide (abbreviated as PPS) and glass fiber. The second part 52 includes a permanent magnet 21, and a lower plate 13. The second part 52 is formed by injecting molding using a mixed material containing the PPS and carbon fiber and taking the permanent magnet 21 as an injection molding insert. In addition, the injection molding material may also be other thermoplastic materials having a relatively good mechanical performance. Referring to FIG. 3, the rotor assembly 50 includes an impeller 1 and a rotor 2 according to function. The impeller 1 includes the upper plate 11, the blades 12 and the lower plate 13. The rotor 2 includes the permanent magnet 21. In this embodiment, the permanent magnet 21 is substantially of an annular structure, and the permanent magnet 21 is formed by injection molding or sintering, and of course, the rotor 2 may also be in other structural forms. In this embodiment, portions of the impeller 1 except the upper plate 11 and the blades 12 are integrally formed with the permanent magnet 21 by injection molding, and the integral piece formed by injection molding is used in the electrically driven pump. The impeller 1 may also be formed separately and may be used in other centrifugal pumps, and is not limited to the electrically driven pump, and is also not limited to be integrally formed with the rotor 2.

Referring to FIG. 3, the impeller 1 includes an inlet 15, the upper plate 11, the blades 12, the lower plate 13, and an outlet 14. The blades 12 are arranged between the upper plate 11 and the lower plate 13. The inlet 15 of the impeller 1 is formed by the upper plate 11. Multiple outlets 14 of the impeller 1 are formed at an outer periphery of the upper plate 11 between adjacent blades 12 and between the upper plate 11 and the lower plate 13. Multiple impeller passages are formed between adjacent blades 12, and each of the impeller passages is in communication with the inlet 15 and one of the outlets 14 of the impeller 1. An upper side and a lower side of each of the impeller passages are closed by the upper plate 11, the lower plate 13, and side walls of blades at the two lateral sides of the impeller passage.

Figure 5:
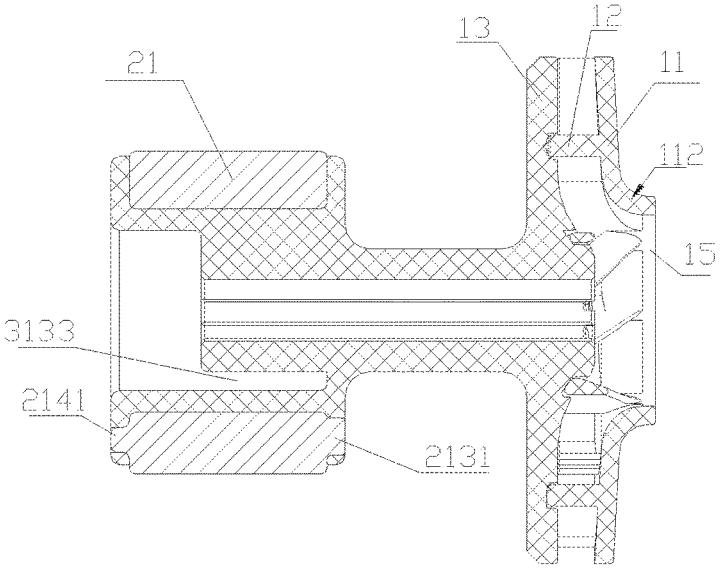
FIG. 5 is a schematic sectional view showing the structure of the rotor assembly in FIG. 2.
Figure 6:
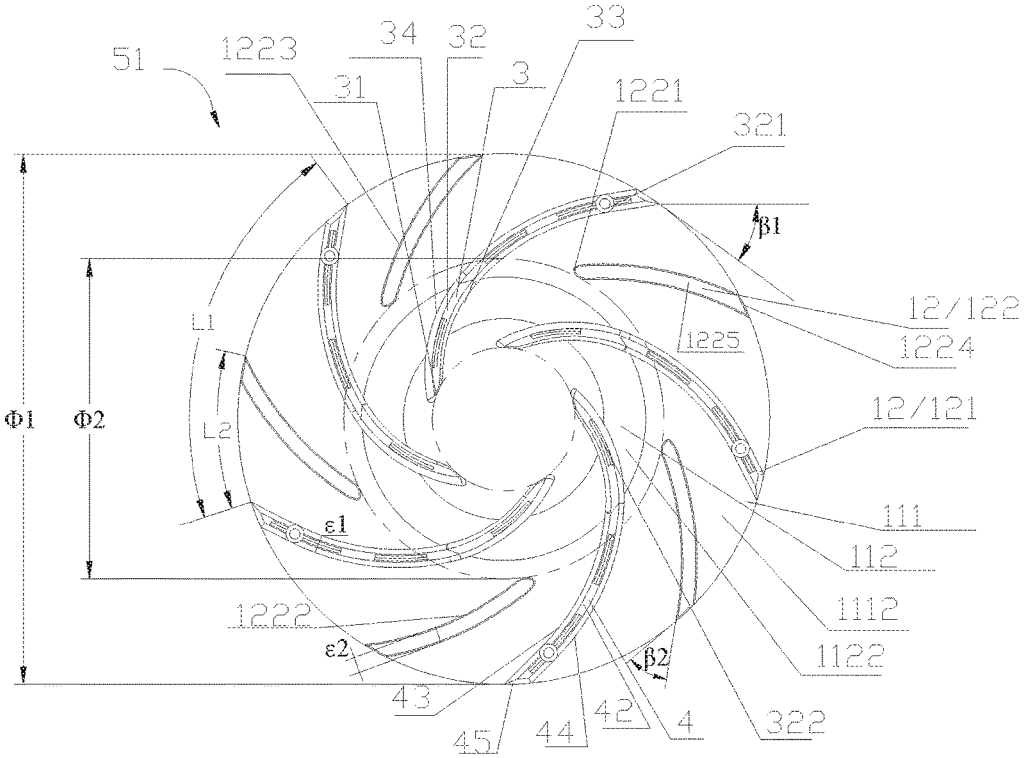
FIG. 6 is a schematic front view showing the structure of a first part in FIG. 2.

Referring to FIGS. 3, 5, and 6, the upper plate 11 is substantially of an annular shape. The upper plate 11 includes a plane portion 111 and a camber portion 112. The plane portion 111 includes an upper plane portion 1111 and a lower plane portion 1112. The camber portion 112 includes a first camber portion 1121 and a second camber portion 1122. The first camber portion 1121 is smoothly transited to the upper plane portion 1111, the second camber portion 1122 is smoothly transited to the lower plane portion 1112, and the inlet 15 of the impeller 1 is formed by encircling of the camber portion 112. The blades 12 are integrally formed with the lower plane portion 1112, or the lower plane portion 1112 and the second camber portion 1122, of the upper plate 11 by injection molding. Referring to FIG. 3, at a side wall of the inlet 15 of the impeller 1, the impeller 1 includes a vertical portion 113 tangential to the side wall of the inlet 15 of the impeller 1, actually, the vertical portion 113 is a partial connecting portion where the upper plate 11 is connected to the blades 12, thus facilitating demolding of the first part 51 of the impeller 1. In this embodiment, the plane portion 111 is set at a certain angle with respect to the horizontal plane, and the blades 12 are arranged to be substantially perpendicular to the horizontal plane. An outer edge of the upper plate 111 defines substantially a first circumference with a diameter of Φ1, and a diameter of the impeller is equal to the diameter of the first circumference, and is also equivalent to an outer diameter of a circle defined by tail portions of outer edges of the blades 12.

Referring to FIGS. 2 and 6, the blades 12 include first blades 121 and second blades 122. The first blades 121 and the second blades 122 are each in a circular-arc shape. A length of each of the first blades 121 is greater than a length of each of the second blades 122. The first blades 121 are distributed at equal intervals along a circumference of the impeller 1, and the second blades 122 are distributed at equal intervals along the circumference of the impeller 1. The number of the first blades 121 is the same as the number of the second blades 122. The first blades 121 and the second blades 122 are distributed alternately along the circumference of the impeller 1, i.e., each of the second blades 122 is arranged between adjacent first blades 121. Each of the first blades 121 and the second blades 122 may each include a camber, or a combination of two or more than two cambers, or a combination of a camber and a plane.

Referring to FIG. 6, the first blades 121 are formed integrally with the lower plane portion 1112 and the second camber portion 1122 of the upper plate 11 by injection molding. Each of the first blades 121 includes a first segment 3 integrally formed with the second camber portion 1122 by injection molding, and a second segment 4 integrally formed with the lower plane portion 1112 by injection molding. The first segment 3 includes a head portion 31, a first bottom 32, a first concave side 33, and a first convex side 34. The second segment 4 includes a second bottom 42, a second concave side 43, a second convex side 44, and a tail portion 45. The head portion 31 protrudes into the inlet 15 of the impeller 1. The head portion 31 is a start end of the first blade 121, and the tail portion 45 is a terminal end of the first blade 121. An arc length between the head portion 31 and the tail portion 45 is the length of the first blade 121. In this embodiment, the first concave side 33 and the second concave side 43 form a first side of the first blade 121. The first convex side 34 and the second convex side 44 form a second side of the first blade 121. The head portion 31 is a first head of the first blade 121, and the tail portion 45 is a first tail portion of the first blade 121. On the first circumference, a first circular arc with a length of L1 is defined between intersections of, the second concave sides 43 of adjacent first blades 121, with the first circumference. The length L1 of the first circular arc is equal to a length of each circular arc defined by equally dividing the first circumference into parts with the number of the first blades 121. In this embodiment, the number of the first blades 121 is five, and the length L1 of the first circular arc is equal to a length of each circular arc defined by equally dividing the first circumference into five parts.

Referring to FIG. 2, a portion where the head portion 31 is located is a flow guiding part of the first blade 121. The working medium enters into the impeller 1 through the inlet 15 of the impeller 1 and is guided into a circulating passage between adjacent first blades 121 via the head portion 31, and the head portion 31 is fixed to an inner side wall of the inlet 15 by injection molding. The first segment 3 further includes a connecting side 1216 arranged between the head portion 31 and the first concave side 33. A distance from the connecting side 1216 to the first convex side 34 is smaller than a distance from the first concave side 33 to the first convex side 34. In this way, the connecting side 1216 allows a thickness of each of the first blades 121 at a section corresponding to the connecting side 1216 to be decreased, thus, a gap between the first blades 121 at the portion from the head portion 31 to a terminal position of the connecting side 1216 may be increased, which may reduce a flowing resistance to the working medium, and allows the working medium to smoothly flow.

Referring to FIGS. 2 and 3, the head portion 31 protrudes into the inlet 15 of the impeller 1. A straight line is defined by passing through a fixing point 311 at which the first blade 121 is fixed to the side wall of the impeller inlet 15 and being in parallel with a center line of the side wall of the inlet 15 of the impeller 1, an included angle between the head portion 31 and the straight line is a front inclination angle θ3 ranging from 20 degrees to 50 degrees. A free end of the head portion 31 inclines to a central axis direction of the impeller inlet 15 by 20 degrees to 50 degrees, in this way, the part where the head portions 31 are located can better restrict flowing of the working medium.

A thickness of each of the first blades 121 is represented by ε1, and the thickness ε1 of the first blade 121 is referred to as a vertical distance between the first side and the second side of the first blade. In this embodiment, considering that the material for forming the blade by injection molding has a certain brittleness, the first blade 121 may be fractured, broken or damaged if it is too thin, therefore, the value of the thickness ε1 of the first blade according to the present application is set relatively large. In this embodiment, the thickness ε1 of the first blade generally ranges from 0.8 mm to 2 mm. In this embodiment, for facilitating demolding, the first side and the second side are provided with small draft angles respectively, since the draft angles are very small, a height difference generated by the draft angles may be neglected when compared to the height of the first blade 121

Referring to FIG. 6, on the first circumference, at an intersection of the second concave side 43 or an extending side of the second concave side of the first blade 121 with the first circumference, an included angle between a tangential line of the second concave side 43 or the extending side of the second concave side 43, and a tangential line of the first circumference at the intersection is a first included angle β1 of the first blade 121. The first included angle β1 of the first blade 121 ranges from 20 degrees to 60 degrees. In this embodiment, the impeller 1 of the electrically driven pump 100 is a low specific speed centrifugal impeller, and a large blade angle is generally configured to reduce a frictional loss of disk as much as possible, thus ensuring the efficient operation of the electrically driven pump. However, the blade angle β1 that is large may adversely affect the performance stability of the impeller, thus in order to acquire a stable performance curve and preventing overloading, for the structure of the impeller 1 according to this embodiment, the first included angle β1 of the first blade 121 according to the present application ranges from 20 degrees to 60 degrees.

Referring to FIGS. 2 and 6, each of the first blades 121 includes a bottom, and the bottom includes the first bottom 32 and the second bottom 42. From a central portion of the upper plate to an edge of the upper plate, a distance from the second bottom 42 to the upper plate 11 gradually decreases. On the first circumference, the tail portion 45 is arranged to be aligned with an outer edge of the upper plate 11 of the impeller. The tail portion 45 is a small section of a cylindrical surface, or the tail portion 45 is a portion of a cylindrical surface defined by extending the outer edge of the upper plate 11. The tail portion 45 connects the second concave side 43 and the second convex side 44 at an end of the first blade 121. The tail portion 45 has a height which is a smallest height of the first blade 121, and the height of the first blade 121 at the tail portion 45 is defined as an outlet height H1 of the first blade 121. The bottom of the first blade 121 is provided with a connecting structure fixed to the lower plate 13. The connecting structure includes a cylindrical protrusion 321 and protruding ribs 322. A height of each of the protruding ribs 322 protruded is smaller than a height of the cylindrical protrusion 321, and the protruding ribs 322 are arranged at intervals along the bottom. Each first blade 121 is provided with one cylindrical protrusion 321 and multiple protruding ribs 322. The free end of the first blade is namely the bottom of the first blade.

Referring to FIG. 6, the second blade 122 is fixed to the plane portion 111 of the upper plate 11 by injection molding. The second blade 122 starts from a second circumference with a diameter of Φ2, and terminates at the first circumference with the diameter of Φ1, and the diameter Φ2 of the second circumference ranges from 0.6 times to 0.75 times of the diameter Φ1 of the first circumference. The second blade 122 includes a front end 1221, a concave side 1222, a convex side 1223, a rear end 1224 and a bottom 1225 of the second blade. The front end 1221 is arranged at the second circumference with the diameter of Φ2, and the rear end 1224 is arranged at the first circumference with the diameter of Φ1. On the first circumference, at an intersection of the concave side 1222 or an extending side of the concave side with the first circumference, an included angle between a tangential line of the concave side 1222 or the extending side of the concave side, and a tangential line of the first circumference is a second included angle β2 of the second blade 122. In this embodiment, the front end 1221 is a second head portion of the second blade 122, and the rear end 1224 is a second tail portion of the second blade 122, the concave side 1222 is a third side of the second blade 122, and the convex side 1223 is a fourth side of the second blade 122. The second included angle β2 of the second blade 122 is smaller than or equal to the first included angle β1 of the first blade 121. In this embodiment, and the second included angle β2 of the second blade 122 is smaller than the first included angle β1 of the first blade 121 by 3 degrees to 10 degrees. Except portions at the front end 1221 and the rear end 1224, a thickness ε2 of the second blade ranges from 0.6 times to 1 times of the thickness ε1 of the first blade, and if the central axis of the inlet of the impeller is taken as a center of circle, a height of the second blade is smaller than or equal to a height of the first blade at the same portion of the circle. The free end of the second blade is namely the bottom of the second blade.

Referring to FIGS. 2 and 6, from the front end 1221 to the rear end 1224, a distance from the bottom 1225 of the second blade 122 to the lower surface of the upper plate gradually decreases, and is the smallest at the first circumference. An outlet height H2 of the second blade is defined as the smallest distance from the second blade bottom 1225 to the lower surface of the upper plate at the first circumference. In this embodiment, a height of the second blade is smaller than a height of the first blade at the same position of the circle, and the outlet height H2 of the second blade is smaller than the outlet height H1 of the first blade. Thus, after the impeller is assembled, a certain gap or a small gap is formed between the second blade bottom 1225 and the lower plate 13. On the first circumference, a second circular arc with a length of L2 is defined between a tangential line of the concave side 1222 of the second blade, and a tangential line of the second concave side 43 of a first blade adjacent to the second blade, and the arc length L2 of the second circular arc ranges from 0.35 times to 0.5 times of the arc length L1 of the first circular arc.

Figure 7:
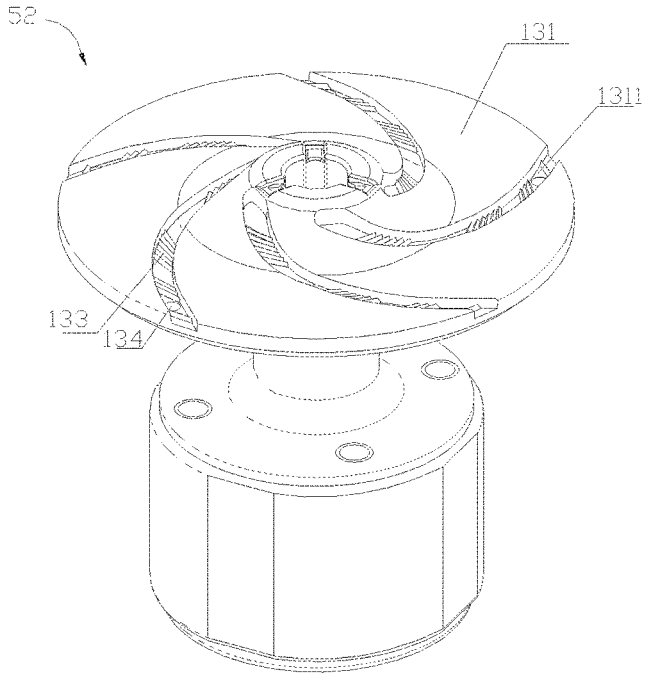
FIG. 7 is a schematic perspective view showing the structure of a second part in FIG. 2.
Figure 8:
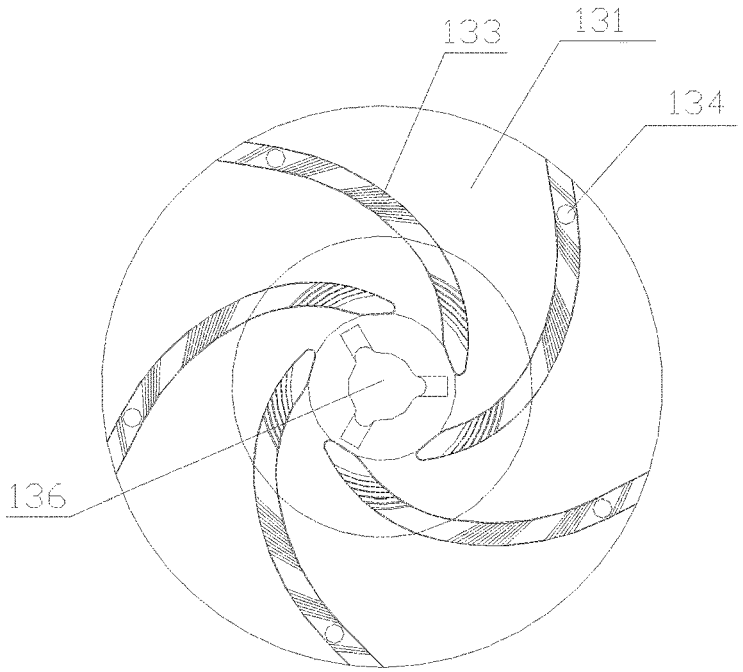
FIG. 8 is a schematic top view showing the structure of the second part in FIG. 7.

Referring to FIGS. 7 and 8, the lower plate 13 includes an upper side 131 and a lower side. The lower plate 13 is fixedly connected to the bottoms of the blades 12 via the upper side 131, the upper side 131 of the lower plate 13 is configured to have a shape matching with the shape of the bottoms of the blades 12, and the lower side of the lower plate 13 is substantially a horizontal plane. Blade mounting grooves 1311 are formed in the upper side 131 of the lower plate 13, and the number of the blade mounting grooves 1311 is the same as the number of the first blades 121. A stripe protrusion 133 is provided in each of the blade mounting grooves 1311, and a small mounting hole 134 extending through the lower plate 13 is further provided in at least one of the blade mounting grooves 1311, and the cylindrical protrusion 321 is provided on the bottom of a first blade corresponding to the at least one blade mounting groove 1311 provided with the small mounting hole 134 so as to fit the small mounting hole 134. In this embodiment, each of the blade mounting grooves 1311 is provided with one small mounting hole 134. During assembly of the impeller 1, each of the cylindrical protrusions 321 of the bottoms 1211 of the first blades 121 is inserted into a respective small mounting hole 134, and each of the bottoms 1211 of the first blades 121 is inserted into a respective blade mounting groove 1311, and the first blades 121 are fixed to the lower plate 13 by ultrasonic welding, thus forming the impeller 1. An impeller mounting hole 136 is formed in the lower plate 13, and the impeller 1 is sleeved on an outer surface of the shaft 40 via the impeller mounting hole 136.

It should be noted that, the above embodiments are only intended for describing the present application, and should not be interpreted as a limitation to the technical solutions of the present application. Although the present application is described in detail in conjunction with the above embodiments, it should be understood by those skilled in the art that, modifications or equivalent substitutions may still be made to the present application by those skilled in the art; and any technical solutions and improvements of the present application without departing from the spirit and scope thereof also fall into the scope of the present application defined by the claims.

What is claimed is:

1. An electrically driven pump, comprising a rotor assembly, a stator assembly, and a partition, wherein the rotor assembly and the stator assembly are partitioned by the partition, the rotor assembly comprises an impeller, the impeller comprises an upper plate, blades and a lower plate, the blades are provided between the upper plate and the lower plate, and the upper plate comprises an upper surface and a lower surface, wherein, the blades and the upper plate are integrally formed by injection molding, the blades are located on the lower surface of the upper plate, the blades comprise first blades and second blades, and each of the first blades and the second blades comprises a camber, or a combination of two or more than two cambers, or a combination of a camber and a plane;

a length of each of the first blades is greater than a length of each of the second blades, the first blades are uniformly distributed along a circumference of the upper plate, and the second blades are uniformly distributed along the circumference of the upper plate;

a number of the first blades is the same as a number of the second blades, and the first blades and the second blades are distributed alternately along the circumferential direction of the upper plate; and each of the first blades comprises a first head portion, a first tail portion, a first side and a second side, the first side is a concave side, and the second side is a convex side, each of the second blades comprises a second head portion and a second tail portion, an outer edge of the upper plate defines a first circumference with a diameter of Φ1, the second head portions of the second blades are located at a second circumference with a diameter of Φ2, and the diameter Φ2 of the second circumference ranges from 0.6 times to 0.75 times of the diameter Φ1 of the first circumference; and wherein, the lower surface of the upper plate comprises a plane portion and a camber portion, each of the first blades comprises a first segment fixed to the plane portion and a second segment fixed to the camber portion, a vertical distance between the first side and the second side at the first segment is a thickness ε1 of each of the first blades at the first segment, and the thickness ε1 of each of the first blades at the first segment ranges from 0.8 mm to 2 mm; and wherein each of the first blades comprises a connecting side, the connecting side is arranged between the first head portion and the first side of each of the first blades, and a distance from the connecting side to the second side is smaller than the thickness ε1 of each of the first blades at the first segment; and the first head portion of each of the first blades is fixed to the upper plate by injection molding, a straight line passing through a fixing point, where the first head portion is fixed to the upper plate, and being in parallel with a central axis of the first circumference is defined, an included angle between the first head portion and the straight line is defined as a front inclination angle θ3 of each of the first blades, the front inclination angle is referred to as a certain acute angle formed by the first head portion rotating from the central axis in a counterclockwise direction, and the front inclination angle θ3 ranges from 20 degrees to 50 degrees.

2. The electrically driven pump according to claim 1, wherein on the first circumference, a circular arc between the first sides of the first blades adjacent to each other is a first circular arc, and an arc length of the first circular arc is a first arc length L1;

each of the second blades comprises a third side and a fourth side, and the third side is a concave side and the fourth side is a convex side; and on the first circumference, a circular arc between the first side of each of the first blades and the third side of the respective adjacent second blade is a second circular arc, and an arc length of the second circular arc is a second arc length L2; and the second arc length L2 ranges from 0.35 times to 0.5 times of the first arc length L1.

3. The electrically driven pump according to claim 2, wherein on the first circumference, an included angle between, a tangential line of the first side or an extending side of the first side of each of the first blades, and a tangential line of the first circumference, at an intersection of the first side or the extending side of the first side with the first circumference, is a first included angle β1;

an included angle between, a tangential line of the third side or an extending side of the third side of the second blade, and a tangential line of the first circumference, at an intersection of the third side or the extending side of the third side with the first circumference, is a second included angle β2; and the first included angle β1 is greater than the second included angle β2.

4. The electrically driven pump according to claim 3, wherein the first included angle β1 ranges from 20 degrees to 60 degrees, and the second included angle β2 is smaller than the first included angle β1 by 3 degrees to 10 degrees.

5. The electrically driven pump according to claim 4, wherein each of the first tail portion and the second tail portion is aligned with the outer edge of the upper plate; on the first circumference, a side of each of the first blades, which is not in direct contact with the upper plate, is a free end of each of the first blades, a distance from the free end of each of the first blades to the lower surface of the upper plate is an outlet height H1 of each of the first blades, a side of each of the second blades which is not in direct contact with the upper plate is a free end of each of the second blades, a distance from the free end of each of the second blades to the lower surface of the upper plate is an outlet height H2 of each of the second blades, and the outlet height H1 of each of the first blades is greater than the outlet height H2 of each of the second blades.

6. The electrically driven pump according to claim 2, wherein each of the second blades is formed by extending from the plane portion of the lower surface of the upper plate towards the lower plate, a vertical distance between the third side and the fourth side of each of the second blades is a thickness ε2 of each of the second blades, and the thickness ε2 of each of the second blades ranges from 0.6 times to 1 times of the thickness ε1 of each of the first blades at the first segment.

7. The electrically driven pump according to claim 1, wherein each of the first tail portion and the second tail portion is aligned with the outer edge of the upper plate; on the first circumference, a side of each of the first blades which is not in direct contact with the upper plate is a free end of each of the first blades, a distance from the free end of each of the first blades to the lower surface of the upper plate is an outlet height H1 of each of the first blades, a side of each of the second blades which is not in direct contact with the upper plate is a free end of each of the second blades, a distance from the free end of each of the second blades to the lower surface of the upper plate is an outlet height H2 of each of the second blades, and the outlet height H1 of each of the first blades is greater than the outlet height H2 of each of the second blades.

8. The electrically driven pump according to claim 2, wherein each of the first tail portion and the second tail portion is aligned with the outer edge of the upper plate; on the first circumference, a side of each of the first blades which is not in direct contact with the upper plate is a free end of each of the first blades, a distance from the free end of each of the first blades to the lower surface of the upper plate is an outlet height H1 of each of the first blades, a side of each of the second blades which is not in direct contact with the upper plate is a free end of each of the second blades, a distance from the free end of each of the second blades to the lower surface of the upper plate is an outlet height H2 of each of the second blades, and the outlet height H1 of each of the first blades is greater than the outlet height H2 of each of the second blades.

9. The electrically driven pump according to claim 3, wherein each of the first tail portion and the second tail portion is aligned with the outer edge of the upper plate; on the first circumference, a side of each of the first blades which is not in direct contact with the upper plate is a free end of each of the first blades, a distance from the free end of each of the first blades to the lower surface of the upper plate is an outlet height H1 of each of the first blades, a side of each of the second blades which is not in direct contact with the upper plate is a free end of each of the second blades, a distance from the free end of each of the second blades to the lower surface of the upper plate is an outlet height H2 of each of the second blades, and the outlet height H1 of each of the first blades is greater than the outlet height H2 of each of the second blades.

* * * * *